US006623898B2

(12) United States Patent
Kabai

(10) Patent No.: US 6,623,898 B2
(45) Date of Patent: Sep. 23, 2003

(54) DEVELOPING AGENT, METHOD FOR MANUFACTURING THE SAME, IMAGE FORMING APPARATUS

(75) Inventor: Takahito Kabai, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/006,131

(22) Filed: Dec. 10, 2001

(65) Prior Publication Data

US 2003/0124444 A1 Jul. 3, 2003

(51) Int. Cl.[7] ..... G03G 9/097
(52) U.S. Cl. ..... 430/45; 430/108.3; 399/223
(58) Field of Search ..... 430/45, 108.3; 399/223

(56) References Cited

U.S. PATENT DOCUMENTS

| | | | |
|---|---|---|---|
| 5,843,605 A | 12/1998 | Anno et al. | |
| 6,127,081 A | 10/2000 | Yamauchi | |
| 6,136,491 A | 10/2000 | Yamauchi | 430/110 |
| 6,160,142 A | 12/2000 | Sawada et al. | |
| 6,192,207 B1 | 2/2001 | Yamamoto et al. | |
| 6,218,065 B1 | 4/2001 | Tanikawa et al. | |
| 6,333,132 B1 | 12/2001 | Tomura | |

FOREIGN PATENT DOCUMENTS

JP 2001-51443 2/2001

OTHER PUBLICATIONS

Handbook of Imaging Materials, Edited by Arthur S. Diamond, Marcel Dekker, Inc., NY 1991.

*Primary Examiner*—Mark A. Chapman
(74) *Attorney, Agent, or Firm*—Folet & Lardner

(57) ABSTRACT

0.01 to 5% by weight of the metal soap is added to the yellow toner and black toner.

26 Claims, 2 Drawing Sheets

DEVELOPING AGENT, METHOD FOR MANUFACTURING THE SAME, IMAGE FORMING APPARATUS

BACKGROUND OF THE INVENTION

The present invention relates to an image forming apparatus used for, for example, an electrostatic type recording apparatus or electrophotographic device, an image forming method and a developing agent applied to these apparatus and method.

Conventionally, there is a technique, as disclosed in, for example, Jpn. Pat. Appln. No. 2001-51443, designed to reduce abrasion of the photosensitive layer of a photoreceptor drum by externally adding or mixing metal soap to a developing agent. In this technique, the metal soap is supplied together with the developing agent to the surface of the photoreceptor, and therefore it is considered that the abrasion of the photoreceptor by the cleaning blade can be reduced due to the slipping effect of the metal soap. As the lifetime of the photoreceptor drum is prolonged, it becomes possible to provide print images at a low cost. However, with the addition of a metal soap, the fluidity of the developing agent is lowered. As a result, a deterioration of image, which is called rough surface, occurs. In particular, full-color images of the skin colors of persons, blue sky or the like are significantly deteriorated. In order to avoid this, it is conventionally necessary to limit the amount of addition of the metal soap.

BRIEF SUMMARY OF THE INVENTION

The object of the present invention is to reduce the abrasion of the photosensitive layer and provide a high image-quality full-color image at a low cost.

According to the first aspect of the present invention, there is provided an image forming apparatus comprising:

an image carrier;

a plurality of developing devices located to face the image carrier and configured to form a developing agent image by developing a static latent image formed on the image carrier;

a transfer device configured to transfer the developing agent image onto a transfer material;

a cleaning device provided in a downstream of the transfer device and configured to collect a remaining developing agent on the image carrier; and a fixing device having a heating member and configured to fix the developing agent image transferred on the transfer member, wherein one of the plurality of developing devices contains a yellow-color developing agent containing a yellow coloring agent, a binder resin and 0.01 to 5% by weight of a metal soap and another one of the plurality of developing devices contains a black-color developing agent containing a black coloring agent, a binder resin and 0.01 to 5% by weight of a metal soap.

Further, according to the second aspect of the present invention, there is provided an image forming method comprising:

forming a static latent image on an image carrier;

forming a developing agent image by using a developing agent selectively supplied from a plurality of developing devices including a yellow-color developing device containing a yellow-color developing agent containing a yellow coloring agent, a binder resin and 0.01 to 5% by weight of a metal soap and a black-color developing device containing a black-color developing agent containing a black coloring agent, a binder resin and 0.01 to 5% by weight of a metal soap;

transferring the developing agent image onto a transfer material;

cleaning a developing agent remaining on the image carrier after the transferring with use of a cleaning unit; and fixing the transferred developing agent image onto the transfer member.

Furthermore, according to the third aspect of the present invention, there is provided a combination of developing agents applied to an image forming method apparatus including a plurality of developing devices configured to form a developing agent image by developing a static latent image, comprising: a yellow-color developing agent to be contained in one of the plurality of developing devices, containing a yellow coloring agent, a binder resin and 0.01 to 5% by weight of a metal soap and a black-color developing agent to be contained in another one of the plurality of developing devices, containing a black coloring agent, a binder resin and 0.01 to 5% by weight of a metal soap.

Additional objects and advantages of the invention will be set forth in the description which follows, and in part will be obvious from the description, or may be leaned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
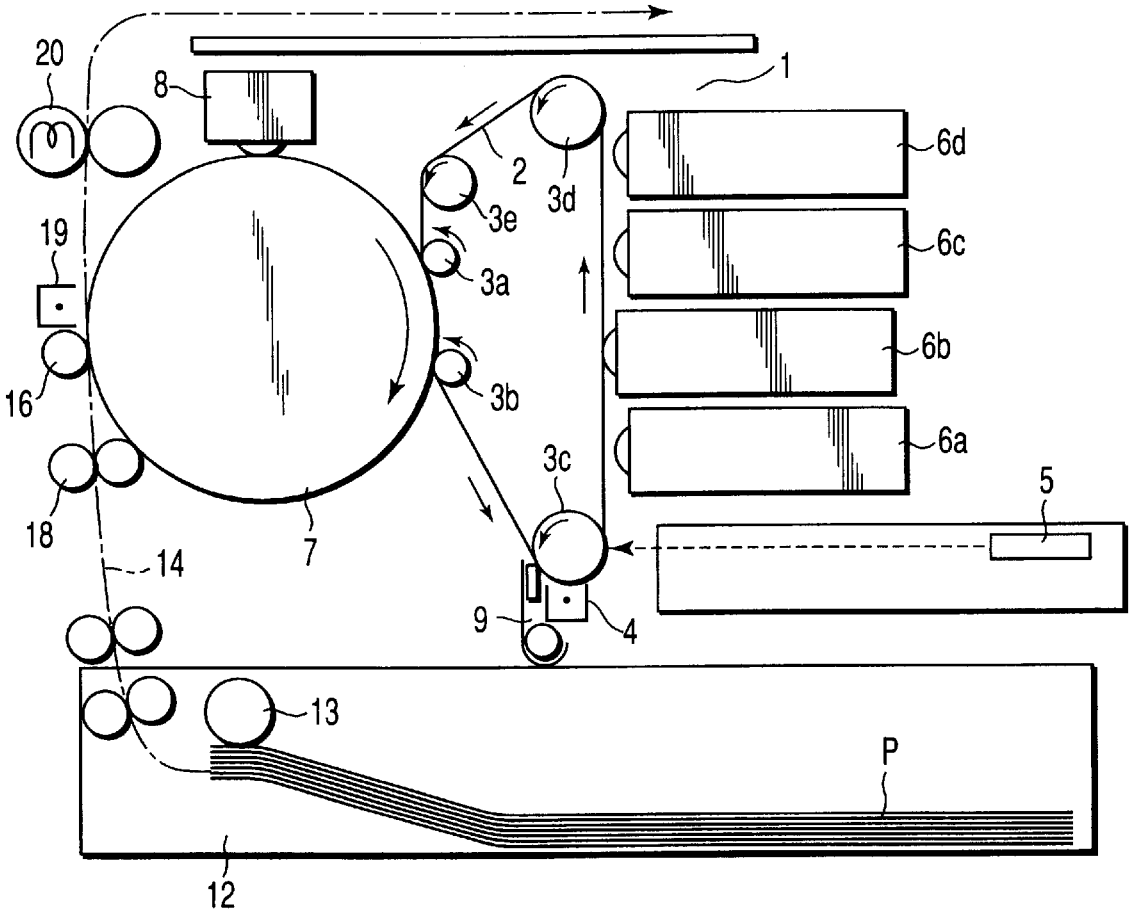
FIG. 1 is a schematic diagram showing the structure of an example of the image forming apparatus according to the present invention.

An image forming apparatus according to the first aspect of the present invention, comprises:

an image carrier;

a plurality of developing devices located to face the image carrier including a yellow-color developing device which contains a yellow-color developing agent containing a yellow coloring agent, a binder resin and 0.01 to 5% by weight of a metal soap and a black-color developing device which contains a black-color developing agent containing a black coloring agent, a binder resin and 0.01 to 5% by weight of a metal soap;

a transfer device configured to transfer the developing agent image onto a transfer material;

a cleaning device provided in a stage behind the transfer unit and configured to collect a remaining developing agent on the image carrier; and a fixing device having a heating member and configured to fix the developing agent image transferred on the transfer member.

Further, the image forming method according to the second aspect of the present invention, comprises:

forming a static latent image on an image carrier;

forming a developing agent image by using a developing agent selectively supplied from a plurality of developing devices provided for a plurality of colors of developing agents, respectively;

transferring the developing agent image onto a transfer material;

cleaning a developing agent remaining on the image carrier after the transferring with use of a cleaning device; and fixing the transferred developing agent image onto the transfer member.

Furthermore, the developing agent according to the third aspect of the present invention is applied to the above-described image forming apparatus, comprises: a yellow-color developing agent to be contained in one of a plurality of developing devices, containing a yellow coloring agent, a binder resin and 0.01 to 5% by weight of a metal soap and a black-color developing agent to be contained in another one of a plurality of developing devices, containing a black coloring agent, a binder resin and 0.01 to 5% by weight of a metal soap.

The black developing agent and yellow developing agent are very frequently used in full-color image formation. Further, with the black developing agent and yellow developing agent, the roughness of image quality and the like are not prominent even if a metal soap is added. Thus, even in the case where a metal soap is added to the black developing agent and yellow developing agent only, the roughness of the image quality and the like do not become prominent, and the metal soap can be fully distributed over an image carrier. Further, the black and yellow developing agents collected by the respective cleaning devices are reserved therein, and the metal soap can be further supplied to the image carrier.

With use of the present invention, the metal soap can be fully supplied onto the image carrier. Therefore, it is possible prevent a flaw being made on the image carrier, as it is scratched with, for example, the cleaning blade provided in the cleaning device and a carrier interposed between transfer rollers or the like, provided in the transfer device. Further, since the metal soap is not used excessively, the deterioration of the image quality, which may be caused by the metal soap, can be suppressed, thereby making it possible to obtain an excellent image.

As described above, according to the present invention, a particular combination of developing agents with a metal soap blended thereto, is applied to an image forming device which employs a developing device having a plurality of developing devices. Thus, the abrasion of the photosensitive layer is suppressed, and a high-quality full-color image can be formed at a low cost.

These developing devices can further include a magenta developing device in which a magenta-color developing agent is contained and a cyan developing device in which a cyan-color developing agent is contained. With these developing devices, images can be formed in full-color.

The metal soap can be added not only to the black developing agent and yellow developing agent, but also to the magenta developing agent and cyan developing agent. Preferably, a developing device containing a magenta developing agent containing a magenta coloring agent, binder resin, and a metal soap in an amount less than the amount of the metal soap contained in the yellow coloring agent; and a developing device containing a cyan developing agent, binder resin, and a metal soap in an amount less than the amount of the metal soap contained in the cyan coloring agent can be included in the image forming device according to the present invention.

The total of the contents of the metal soaps should preferably be 0.02 to 20% by weight. If the total amount is less than 0.02% by weight, there is such a tendency that the abrasion effect of the photoreceptor cannot be obtained, whereas if the total amount exceeds 20% by weight, there is such a tendency that an excessive slipping effect results due to the amount of the metal soap, thus creating a drawback of cleaning error or the like.

Examples of the metal soap are zinc stearate, aluminum stearate, calcium stearate, magnesium stearate, zinc behenate, aluminum behenate, calcium behenate, magnesium behenate, zinc laurate, aluminum laurate, calcium laurate and magnesium laurate.

Examples of the binder resin which can be used for the developing agent are polyester resin, polystyrene resin, styrene-acrylate copolymer resin, polyester-styreneacrylate hybrid resin, epoxy resin, polyether-polyol resin.

Examples of the wax which can be used for the developing agent are natural waxes such as rise wax and carnauba wax, a petroleum wax such as paraffin wax, and synthesized waxes such as fatty acid ester, fatty acid amide, low molecular weight polyethylene and low molecular weight polypropylene.

Examples of the coloring agent are carbon black, organic and inorganic pigments and dyes. Although it is not particularly limited, examples of the carbon black are acetylene black, furnace black, thermal black, channel black and ketchen black.

Examples of the pigment and dye are Pigment Yellow 180, Fast Yellow G, Benzidine Yellow, Indofast Orange, Irgazine Red, Carmine FB, Carmine 6B, Permanent Bordeaux FRR, Pigment Orange R, Pigment Red 122, Lithol Red 2G, Lake Red C, Rhodamine FB, Rhodamine B Lake, Phthalocyanine Blue, Pigment Blue 15-3, Brilliant Green B, Phthalocyanine Green, and Quinacridon may be used singly or in combination.

If necessary, other additives such as a charge controller, an interior/exterior lubricant, a cleaning additive, and a fluidization agent may be used.

In the meantime, these developing devices of the present invention can be arranged in the following manners. For example, four developing devices can be individually arranged around the image carrier. In this case, each of the devices is set to face the image carrier. It is also possible that the four developing devices are arranged in four sections formed within one rotation-type developing unit. Further, it is further possible that three of the four developing devices are arranged in three sections formed within one rotation-type developing unit, and the other one single color (monochrome) developing device is provided to be independent from this rotation-type developing unit.

Next, the present invention will now be described in more detail with reference to drawings.

FIG. 1 is a schematic diagram showing the structure of an example of the image forming apparatus according to the present invention.

The image forming apparatus includes an image forming portion 1. The image forming portion 1 includes a photoreceptor belt 2 serving as an image carrier. The photoreceptor belt 2 is stretched over between a plural number of first to fifth rollers 3*a* to 3*e* such as to be able to run along the direction indicated by an arrow at a predetermined tension.

Around the photoreceptor belt 2, a charger device 4 for charging the photoreceptor belt 2 at a predetermined potential along its running direction, an exposure device 4 serving as an image forming device for forming an electrostatic latent image on the charged photoreceptor belt 2 and first to fourth developing devices 6*a* to 6*d* for supplying toner serving as a developing agent onto the latent image formed on the photoreceptor belt 2. Further, around the photoreceptor belt 2, a rotatable intermediate transfer member 7 for temporarily holding a toner image formed on the photoreceptor belt 2 and a cleaner device 9 for removing the toner remaining on the photoreceptor belt 2 are arranged in the belt's running direction. On an upper side of the intermediate transfer member 7, a cleaner 8 for cleaning the intermediate transfer 7 is provided.

The photoreceptor belt 2 is arranged in such a manner that the portion stretched over between the first and second rollers 3*a* and 3*b* is placed in tight contact with the circumferential surface of the intermediate transfer member 7, and the portion stretched over between the third and fourth rollers 3*c* and 3*d* faces via certain gaps the developing units 6*a* to 6*d*.

It should be noted that either one of the first to fifth rollers 3*a* to 3*e* is connected to a drive motor (not shown), and due to the rotation of the drive motor, the first to fifth rollers 3*a* to 3*e* are rotated at a predetermined speed in the direction indicated by the arrow.

On the other hand, underneath the image forming portion 1, a sheet cassette 12 for loading sheets P serving as a transfer material having a predetermined size is provided. A paper feeding roller 13 is provided in the sheet cassette 12 in order to feed out the sheets P one by one.

Between the sheet cassette 12 and the intermediate transfer member 7, a conveying path 14 for conveying a sheet P towards the intermediate transfer member 7, is provided along the vertical direction. A transfer roller 16 serving as a transfer device is provided in the conveying path 14 such that the roller faces the intermediate transfer member 7, and the transfer roller serves to transfer the toner image formed on the intermediate transfer member 7 onto the sheet P.

An aligning roller 18 is provided on an upstream side to the transfer roller 16 with regard to the sheet conveying direction. The aligning roller 18 temporarily stops a sheet P conveyed by the conveying system 14, and then corrects the inclination of the sheet P with respect to the conveying direction, and sets the leading end of the sheet P to match with the leading end of the toner image on the intermediate transfer member 7.

On a downstream side to the transfer roller 11 with regard to the sheet conveying direction, a separating device 19 for separating the sheet P on which the toner image has been transferred, from the intermediate transfer member 7 by applying an AC charge thereto, and a fixing device 20 for fixing the toner image transferred on the sheet P, to the sheet P are arranged.

Next, the full-color printing operation of the image forming apparatus described above will now be described.

First, the surface of the rotating photoreceptor belt 2 is charged uniformly at a predetermined potential by the charging device 4. Subsequently, an exposure corresponding to a yellow image is carried out on the photoreceptor belt 2 by the exposing device 4, so as to form a static latent image. The latent image is developed as yellow toner is supplied thereto from a yellow developing device 1*a,* and thus obtained developing agent image is transferred onto the intermediate transfer member 7. After the transferring operation, the photoreceptor belt 2 is separated from the intermediate transfer member 7, and then it is photodestaticized by a charge-removing device which is not shown in the figure.

On the other hand, the toner remaining on the photoreceptor belt 2 without having been transferred to the intermediate transfer member 7 is cleaned with the cleaner device 9. The toner removed by the cleaning is collected in a waste toner box which is not shown in the figure. After a while, the photoreceptor belt 2 is re-charged by the charging device 4 and thus an exposure corresponding to a magenta image is carried out by the exposure device 5, thereby forming a static latent image thereon. This static latent image is developed with a magenta toner by a magenta developing unit 6*b,* and thus this magenta toner image is transferred onto the intermediate transfer member 7 to be interposed on the yellow image on the transfer member. A similar procedure to the above is carried out for a cyan image and a black image as well, thereby forming a four-color multiple layered toner image on the intermediate transfer member 7.

After the image formation described above, a sheet P is fed between the intermediate transfer member 7 and the transfer roller 16, and the four-color multiple layered toner image is secondarily transferred in batch on the sheet P. The sheet P on which the four-color multiple layered toner image has been transferred, is separated from the intermediate transfer member 7 by a separator charger 19. This separated sheet P is conveyed to the fixing device 20, where the toners are fixed to obtain a color image.

On the other hand, the toner portion remaining unused after transferring the image on the sheet P, remains on the intermediate transfer member 7. The remaining toner is cleaned by a cleaner 8 which is brought into contact with the intermediate transfer member 7 after finishing the secondary transfer operation.

It should be noted that while the above-described four-color multiple layered image is being formed on the intermediate transfer member 7, the cleaner 7 is separated from the intermediate transfer 7.

Figure 2:
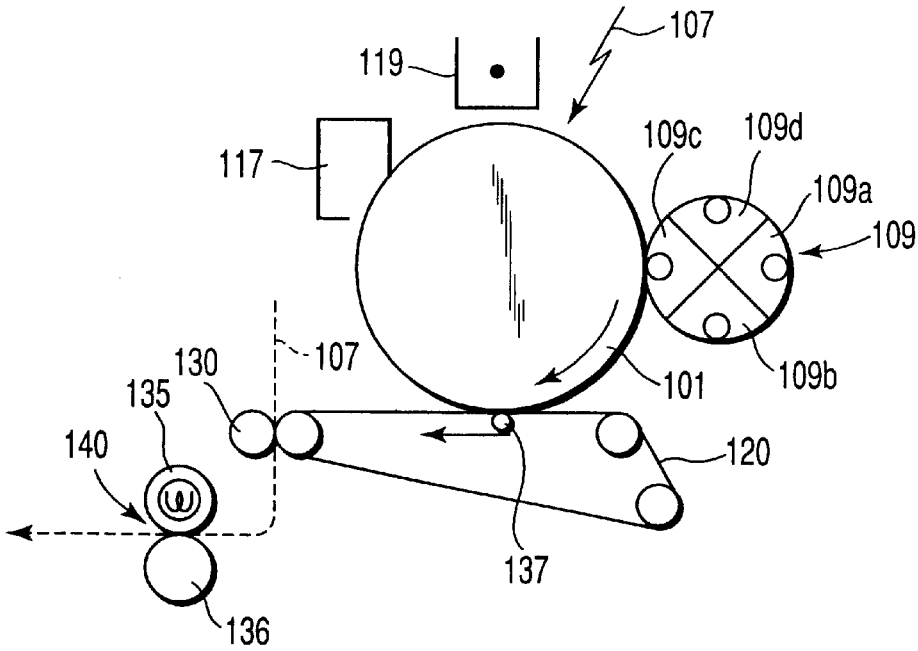
FIG. 2 is a schematic diagram showing the structure of another example of the image forming apparatus according to the present invention.

In the meantime, FIG. 2 is a schematic diagram showing the structure of another example of the image forming apparatus according to the present invention.

As shown in the figure, a photoreceptor drum 101 serving as an image carrier is a cylindrical laminate-type organic photoreceptor, and is provided rotatable in the direction indicated by the arrow as shown in the figure.

Around the photoreceptor drum 101, the following members are arranged along its rotating direction.

First, a developing device 109 which contains a developing agent and serves to develop, with this developing agent, a static latent image formed by an exposing unit 107 develop is provided such as to face the photoreceptor drum 101. On a downstream of the developing device 109, an intermediate transfer belt 120 supported to be able to run in the direction indicated by the arrow in the figure by three rollers is provided such as to face the photoreceptor drum 101. As the material of the intermediate transfer belt, those having sufficient properties in terms of charge retaining power and uniform surface state are required because the belt must temporarily hold the developing agent.

Further, a transfer roller 130 is set on the intermediate transfer belt 120 and a paper-feeding cassette (not shown)

which stores sheets is provided near the transfer roller 130. Paper sheets are conveyed in the direction indicated by an arrow 107 from the paper-feeding cassette and then sent between the intermediate transfer member 120 and transfer means 130.

On a downstream side to the photoreceptor drum 101, a blade cleaning device 117 and a charge-removing lamp 119 are provided. The blade cleaning device 117 is designed to remove the remaining portion of the developing agent by scraping it off with a blade which is not shown in the figure, after the transfer of a developing agent image. The charge-removing lamp 119 is a tungsten lamp which can photo-destaticizing the surface of the photoreceptor drum 101 after the transfer of an image. When the destaticization with the charge-removing lamp 119 is finished, one cycle of an image formation is completed. For the next image formation, if there is, the photoreceptor drum 101, currently uncharged, is re-charged.

Then, the sheet on which the developing agent image has been transferred by the transfer roller 130 is sent to the fixing device 140.

The developing unit 109 is sectionalized into four sections as shown in the figure, and these sections respectively include a yellow developing portion 109*a,* a magenta developing portion 109*b,* a cyan developing portion 109*c* and a black developing portion 109*d.* The developing unit 109 is arranged rotatable such that the yellow developing portion 109*a,* the magenta developing portion 109*b,* the cyan developing portion 109*c* and the black developing portion 109*d* can face the photoreceptor drum 101 in this order one after another. These developing portions contain, respectively, a yellow developing agent, a magenta developing agent, a cyan developing agent and a black developing agent.

The image forming operation by an image forming apparatus having such a structure as above will now be described.

First, with use of charging means which is not shown in the figure, a bias voltage is applied onto the photoreceptor drum 101 so as to uniformly charge the surface of the photoreceptor drum 101. Next, a light exposure 107 is applied onto the surface of the photoreceptor drum 101, and thus a first static latent image is formed thereon. Then, the developing portion 109*a* is disposed to face the first latent image and supplies the yellow developing agent thereto, thereby forming a yellow developing agent image.

To the intermediate transfer belt 120, a bias voltage is applied from power feeding means 137. As the bias voltage is applied, a transfer electric field is formed between the photoreceptor drum 101 and the intermediate transfer belt 120. First, the yellow developing agent image formed on the photoreceptor drum 1 is transferred to the intermediate transfer belt 120.

After that, the remaining portion of the yellow developing agent and the remaining charge on the photoreceptor drum 101 are removed by the cleaning device 117 and the charge-removing means 119, respectively.

On the photoreceptor drum 101 from which the yellow developing agent and charge have been removed, a second static latent image is formed with a light exposure 107. The developing device is rotated by ¼, and the developing unit 109*b* is disposed to face the photoreceptor drum 101.

In this manner, the magenta developing agent is supplied to the second static latent image, thereby forming a magenta developing agent image. After that, to the intermediate transfer belt 120, a bias voltage is applied once again from the power feeding means 137. As the bias voltage is applied, a transfer electric field is formed between the photoreceptor drum 101 and the intermediate transfer belt 120. Thus, the magenta developing agent image formed on the photoreceptor drum 1 is transferred further to the intermediate transfer belt 120 on which the yellow developing agent image has been transferred.

With regard to the cyan developing agent and black developing agent, similar steps are repeated and thus yellow, magenta, cyan and black developing agent images are formed as a multiple layers.

To a transfer position situated between the intermediate transfer belt 120 on which the image formed by multiple transfer is carried, and the transfer roller 130, a paper sheet P is conveyed. Then, the yellow, magenta, cyan and black developing agent images formed on the intermediate transfer member 120 are transferred to the paper sheet P.

The paper sheet P which carries the image formed by the multiple transfer is conveyed in the direction indicated by the arrow 107, and sent to the fixing device 140 which includes a heating roller 135 and a pressure roller 136. As the paper sheet P is allowed to pass through the heating roller 135 and the pressure roller 136 while the image formed on the sheet being in contact with the heating roller 135, the image is fixed onto the sheet P. Thus obtained image has a good quality.

In the image forming apparatus described above, a particular combination of developing agents defined by the present invention is used. An example of the developing agent is that made of a yellow color developing agent containing a yellow coloring agent, a binder resin and a metal soap at 0.01 to 5% by weight, a magenta color developing agent containing a magenta coloring agent and a binder resin, a cyan color developing agent containing a cyan coloring agent and a binder resin, and a black color developing agent containing a black coloring agent to be contained in one of a plurality of developing units, and a metal soap 0.01 to 5% by weight.

Figure 3:
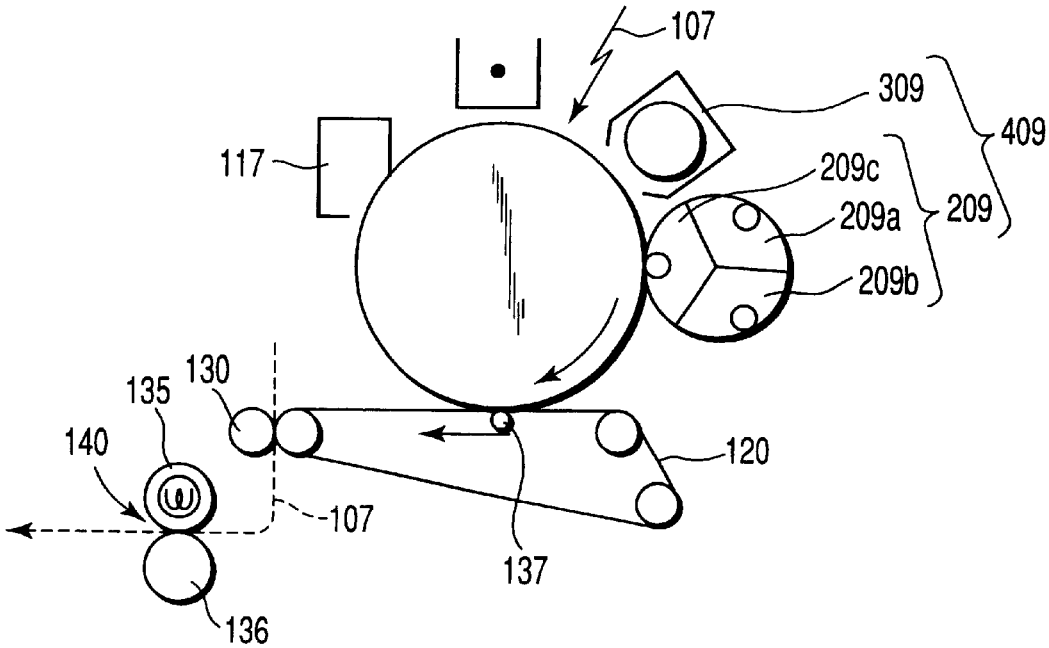
FIG. 3 is a schematic diagram showing a different version from that shown in FIG. 2.

FIG. 3 is a schematic diagram showing another version of the apparatus shown in FIG. 2.

As shown in the figure, this image forming apparatus has a similar structure to that shown in FIG. 2 except for the followings. That is, in place of the developing device 109, a developing unit comprising a rotation-type developing device 209 including a yellow developing portion 209*a,* a magenta developing portion 209*b* and a cyan developing portion 209*c,* and another developing device 409 consisting of a fixation-type black developing portion 309 is used in this apparatus.

The image formation by this apparatus is carried out in a similar manner to that of the apparatus shown in FIG. 2 except for the followings. That is, after the first static latent image is developed, the developing unit is rotated by ⅓ until the second static latent image is developed, and the black developing agent is supplied to the fixation-type single color developing portion.

The present invention will now be described in more detail by presenting specific examples.

First, in order to examine the amount of the metal soap, the abrasion of the photoreceptor, the properties such as the roughness of image, the following tests were carried out.

Test 1

First, the following toner material of the specified color was prepared.

Magenta-color toner composition

Magenta color agent: PIGMENT RED 184 . . . 4 parts by weight

CCA: Zr metal complex (manufactured by Hodogaya Kagaku K.K.) . . . 1 part by weight Binder Resin: Polyester resin . . . 95 parts by weight The toner particle material given above was uniformly mixed preliminarily with a Henschel mixer (manufactured by Mitsui Kouzan K.K), followed by melting and kneading the resultant mixture by using a pressurizing kneader. The kneaded material thus obtained was dried and then roughly pulverized in a pin mill. Further, the roughly pulverized material was finely pulverized by a I-type jet mill machine (Manufactured by Hosokawa Micron K.K.), followed by classifying the finely pulverized material into a size of 8 μm so as to obtain toner particles.

Further, 1 part by weight of silica treated with a silane coupling agent and 0.01 part by weight of zinc stearate were added to 100 parts by weight of thus obtained toner particles, and mixed in a Henschel mixer so as to obtain a toner.

6% by weight of the toner thus prepared was mixed with 94% by weight of a ferrite carrier coated with a silicone resin so as to obtain a magenta developing agent.

Thus magenta developing agent thus obtained was applied in a developing device of "Premarju 455" (manufactured by Toshiba Corporation) so as to form images consecutively for 30,000 sheets.

In the meantime, the following tests were carried out in the respective steps described above.

Print Wear-out-proof Test

The diameter of the photoreceptor was measured in advance, and images were formed continuously on 30,000 sheets. Then, the diameter of the photoreceptor was measured once again. In order to examine the state of the abrasion of the photoreceptor, the amount of change in the diameter of the photoreceptor between before and after the image formation was calculated. The obtained results were presented in TABLE 1 below.

Cleaning Error Test

After images were formed continuously on 30,000 paper sheets, set-solid images of size A3 were continuously collected. Then, the surface of the photoreceptor and the surface of the image were observed by eye, so as to confirm whether or not there is a cleaning error.

The evaluation was made on the basis of the following criteria. That is, ◎ indicates the case where there is no error either on the surface of the photoreceptor or on the surface of the image after 100 sheets of continuous image formation, ○ indicates the case where there is no error on the surface of the photoreceptor but on the surface of the image after 100 sheets of continuous image formation, Δ indicates the case where there is no error on the surface of the photoreceptor but on the surface of the image after 10 sheets of continuous image formation, and X indicates the case where there is an error on the surface of the photoreceptor or on the surface of the image after 10 sheets of continuous image formation.

Thus obtained results are presented in TABLE 1 below.

Toner Fluidity Test 20 g of thus obtained toner was sieved with a mesh of a sieve opening of 75 μm and the weight of the remaining toner sieved out on the mesh was measured.

Thus obtained results are presented in TABLE 1 below.

Monotone Image Test

As a single color image, a half-tone image made of uniform dots was formed with "Fantasia 22i" manufactured by TOSHIBA Corporation. The state of the roughness of the image was observed by eye.

The evaluation was made on the basis of the following criteria. That is, ◎ indicates the case where there is no roughness observed in the image regardless of the concentration of the half-tone, ○ indicates the case where there is some roughness observed in the image when the half-tone is at a low concentration, Δ indicates the case where there is prominent roughness observed in the image when the half-tone is at a low concentration, and X indicates the case where there is a roughness observed when the half-tone is at both low and high concentrations.

Overall Image Test

Of yellow toner, magenta toner, cyan toner and black toner, toners to which metal soaps were not added except for the toner of the Example 1 described above were used respectively, and general images including eight kinds of patterns such as persons, for example, black, white and/or yellow people, blue sky, green lawn, water flow and flower petal of lily were formed using Fantasia 22i. The state of the roughness of the image was visually observed.

The evaluation was made on the basis of the following criteria. That is, ◎ indicates the case where there is no roughness in any of the eight kinds of patterns, ○ indicates the case where there is a roughness in some of the patterns, which would not make any problem, Δ indicates the case where there is a roughness in all of the eight kinds of patterns, which would not make any problem, and X indicates the case where there is a prominent roughness in all of the eight kinds of patterns.

Thus obtained results are presented in TABLE 1 below.

Comparative Test 1

As a comparative test, a toner was prepared in the same manner as in Example 1 except that a metal soap was added. With use of this toner, the same tests as in the case of Example 1 were carried out.

Thus obtained results are presented in TABLE 1 below.

Test 2

A toner was prepared in the same manner as in Example 1 except that the amount of the metal soap added was 1.0% by weight. With use of this toner, the same tests as in the case of Example 1 were carried out. Thus obtained results are presented in TABLE 1 below.

Test 3

A toner was prepared in the same manner as in Example 1 except that the amount of the metal soap added was 5.0% by weight. With use of this toner, the same tests as in the case of Example 1 were carried out. Thus obtained results are presented in TABLE 1 below.

Comparative Test 2

A toner was prepared in the same manner as in Example 1 except that the amount of the metal soap added was 7.0% by weight. With use of this toner, the same tests as in the case of Example 1 were carried out. Thus obtained results are presented in TABLE 1 below.

Test 4

A toner was prepared in the same manner as in Example 1 except that the amount of the metal soap added was 1.0% by weight and the coloring agent was changed to 4 parts by weight of Pigment Yellow 180. With use of this toner, the same tests as in the case of Example 1 were carried out. Thus obtained results are presented in TABLE 1 below.

Test 5

A toner was prepared in the same manner as in Example 1 except that the amount of the metal soap added was 1.0% by weight and the coloring agent was changed to 3 parts by weight of Pigment Blue 15-3. With use of this toner, the same tests as in the case of Example 1 were carried out. Thus obtained results are presented in TABLE 1 below.

Test 6

A toner was prepared in the same manner as in Example 1 except that the amount of the metal soap added was 1.0% by weight and the coloring agent was changed to 4 parts by weight of carbon black manufactured by Mitsubishi Kagaku K.K. With use of this toner, the same tests as in the case of Example 1 were carried out. Thus obtained results are presented in TABLE 1 below.

TABLE 1

| | Developing agent's color | Amount of metal soap added | Wear-out proof | Toner fluiding | Single color image | Overall image | Cleaning error |
|---|---|---|---|---|---|---|---|
| Comparative Text 1 | magenta | none | 10 μm | 1 g | ◎ | ◎ | ○ |
| Test 1 | magenta | Zn-St = 0.1% | 5 μm | 3 g | ○ | ○ | ○ |
| Test 2 | magenta | Zn-St = 1.0% | 2 μm | 8 g | Δ | Δ | ○ |
| Test 3 | magenta | Zn-St = 5.0% | 1 μm | 11 g | Δ | Δ | ○ |
| Comparative Test 2 | magenta | Zn-St = 7.0% | 0.8 μm | 12 g | Δ | Δ | X |
| Test 4 | yellow | Zn-St = 1.0% | 2 μm | 8 g | ◎ | ◎ | ○ |
| Test 5 | cyan | Zn-St = 1.0% | 2 μm | 8 g | Δ | Δ | ○ |
| Test 6 | black | Zn-St = 1.0% | 2 μm | 8 g | Δ | ◎ | ○ |

From the Comparative Test 1, Tests 1 and 2, it can be understood that the amount of the abrasion of the surface of the photoreceptor can be improved (lessened) by adding a metal soap (zinc stearate). However, at the same time, as the amount of the metal soap added is increased, the fluidity of the toner is deteriorated. As a result, it is observed that the single color image and overall image are deteriorated as well in terms of roughness.

From Test 3 and Comparative Test 2, it can be understood that when the amount of the metal soap added exceeds 5%, a cleaning error occurs. This is because when the amount of supply of the metal soap is increased, the friction between the photoreceptor and the cleaning blade is significantly decreased, and therefore the cleaning cannot be sufficiently performed.

In Test 4, excellent images can be obtained in both single color and overall image evaluations despite the fact that the metal soap was added. This is because with regard to the yellow image, the roughness cannot be well caught in terms of human visual sense. On the other hand, in Test 5, some roughness was observed despite that a similar metal soap was added. This is because the roughness of a cyan color image can be caught visually more easily as compared to the case of a yellow color image.

In Test 6, an excellent image in terms of the overall image evaluation can be obtained although the image exhibits some roughness in terms of the single color image evaluation. This is because a black-color image is not substantially used in the sections where many observers pay particular attention, such as the color of human skin, a blue sky and the appearance of the state of a fruit. Further, in such an image, a natural gray color can be reproduced in a gray color region in a better quality with a so-called process black made of a yellow-color toner, a magenta toner and a cyan toner.

From Comparative Test 2, it can be understood that when the amount of the metal soap added per one color exceeds 5%, a cleaning error occurs. Therefore, it is desirable that the amount of the metal soap contained in the four-color developing agents can be preferably 0.01 to 20% by weight. For example, in the case where only the yellow developing agent contains the metal soap, it is possible that it is added in a range of 0.01 to 20% by weight. Further, the yellow developing agent is used, in most of the cases, as one of four colors in multiple by rotating the photoreceptor four times, and therefore it would make no problem even if 20% by weight of the metal soap is added to the yellow coloring agent.

In the case where the metal soap is added to the black developing agent only, it is possible to add it in a range of 0.01 to 5% by weight in consideration of the case where the operation is carried out continuously in a monochrome mode.

As Comparative Example 7, a yellow toner having Zn-St= 20.0%, magenta, cyan and black toners which do not contain the metal soap, were supplied to a full-color copier "Fantasia 70" manufactured by TOSHIBA TECH to fill it, and images were formed. Thus obtained images outputted had an excellent quality in terms of roughness in the single color and overall image evaluations. In the meantime, in the print wear-out proof test, a cleaning error does not occur, or the amount of the abrasion of the layer on the photo-receptor after 30,000 sheets of a full-color image formation was as good as 1 μm.

From the tests carried out above, it can be understood that a roughness of an image can be easily realized visually in the cases of the magenta toner and cyan toner when the metal soap is added to these toners; however a roughness of an image cannot be easily realized visually in the cases of the yellow toner and black toner even if the metal soap is added to these toners.

Next, examples in which the metal soap was added to at least the yellow toner and black toner, and image formation was carried out, will now be presented.

EXAMPLE 1

A yellow toner similar to that used in Test 4, a black toner similar to that used in Test 6, a magenta toner similar to that used in Comparative Test 1, which does not contain the metal soap, and a cyan toner similar to that used in Comparative Test 1, which does not contain the metal soap, except that Pigment Blue 15-3 in place of Pigment Red 184, were used in combination and supplied to a full-color copier "Fantasia 70" manufactured by TOSHIBA TECH. Then, the copying operation was carried out continuously 30,000 times, and the print wear-out proof test was carried out. The result indicates that the amount of change in the diameter of the photoreceptor after 30,000 times of the copying operation was 1.81 μm.

Further, a result of a mark ô was obtained in the overall image test.

EXAMPLE 2

A yellow toner similar to that used in Test 4, a black toner similar to that used in Test 6, a magenta toner similar to that used in Test 1, and a cyan toner similar to that used in Test 1 except that Pigment Blue 15-3 in place of Pigment Red 184, were used in combination and supplied to a full-color copier "Fantasia 70" manufactured by TOSHIBA TECH. Then, the copying operation was carried out continuously 30,000 times, and the print wear-out proof test was carried out. The result indicates that the amount of change in the diameter of the photoreceptor after 30,000 times of the copying operation was 1.75 μm.

Further, a result of a mark ○ was obtained in the overall image test.

As described above examples, in the electrophoto-graphic device including one photoreceptor and a plurality of developing units, the life of the photoreceptor can be prolonged while maintaining the image quality and the toner properties, etc., to some degree simply by adding the metal soap to at least yellow and/or black toners.

Further, in the device, a so-called monochrome mode which forms an image with the black toner is used in some cases, and thus in this regard as well, it is possible to supply a metal soap to the photoreceptor at all times if the black toner contains the metal soap. With regard to the roughness of an image formed by the monochrome mode, the requirement for the image quality is not as severe as the case of the full-color image as in the case of the conventional monochrome image forming device, and therefore such a roughness would not make a particular problem.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image carrier;

a plurality of developing devices located to face said image carrier and configured to form a developing agent image by developing a static latent image formed on the image carrier;

a transfer device configured to transfer said developing agent image onto a transfer material;

a cleaning device provided in a stage behind said transfer device and configured to collect a remaining developing agent on the image carrier; and a fixing device having a heating member and configured to fix said developing agent image transferred on the transfer material, wherein said plurality of developing devices comprise:

a yellow-color developing device that contains a yellow-color developing agent containing a yellow coloring agent, a binder resin and 0.01 to 5% by weight of a metal soap;

a magenta-color developing device that contains a magenta-color developing agent containing a magenta coloring agent, a binder resin and a metal soap which is smaller in amount than the metal soap contained in the yellow-color developing agent or which is zero in amount;

a cyan-color developing device that contains a cyan-color developing agent containing a cyan coloring agent, a binder resin and a metal soap which is smaller in amount than the metal soap contained in the yellow-color developing agent or which is zero in amount; and a black-color developing device that contains a black-color developing agent containing a black coloring agent, a binder resin and 0.01 to 5% by weight of a metal soap.

2. An image forming apparatus according to claim 1, wherein said plurality of developing devices further comprises a magenta-color developing device housing a magenta-color developing agent containing a magenta coloring agent, a binder resin and a metal soap at an amount less than that of said metal soap contained in said yellow developing agent, and a cyan-color developing device housing a cyan-color developing agent containing a cyan coloring agent, a binder resin and a metal soap at an amount less than that of said metal soap contained in said yellow developing agent.

3. An image forming apparatus according to claim 1, wherein a total amount of the contents of said metal soap used is 0.02 to 20% by weight of the total weight of the developing agents.

4. An image forming apparatus according to claim 1, wherein the metal soap is selected from the group consisting of zinc stearate, aluminum stearate, calcium stearate, magnesium stearate, zinc behenate, aluminum behenate, calcium behenate, magnesium behenate, zinc laurate, aluminum laurate, calcium laurate and magnesium laurate.

5. An image forming apparatus according to claim 1, wherein said plurality of developing device include a developing unit having two or more developing devices and a single color developing device provided independent from the developing unit.

6. An image forming apparatus according to claim 1, wherein the cleaning device includes a cleaning blade.

7. An image forming apparatus according to claim 1, wherein only the yellow-color developing agent and the black-color developing agent contain the metal soap.

8. An image forming apparatus according to claim 1, wherein:

the magenta-color developing agent contains a metal soap in an amount of 0.1 to 1.0% by weight, which is smaller in amount than the metal soap contained in the yellow-color developing agent; and the cyan-color developing agent contains a metal soap in an amount of 0.1 to 1.0% by weight, which is smaller in amount than the metal soap contained in the yellow-color developing agent.

9. An image forming apparatus according to claim 1, wherein:

the magenta-color developing agent contains a metal soap in an amount at which roughness of the image quality does not become prominent, and which is smaller in amount than the metal soap contained in the yellow-color developing agent; and the cyan-color developing agent contains a metal soap in an amount at which roughness of the image quality does not become prominent, and which is smaller in amount than the metal soap contained in the yellow-color developing agent.

10. An image forming apparatus according to claim 9, wherein:

the magenta-color developing agent contains a metal soap in an amount of 1.0% by weight or less; and the cyan-color developing agent contains a metal soap in an amount of 1.0% by weight or less.

11. An image forming method comprising:

forming a static latent image on an image carrier;

forming a developing agent image by using a developing agent optionally supplied from a plurality of developing devices comprising:

a yellow-color developing device that contains a yellow-color developing agent containing a yellow coloring agent, a binder resin and 0.01 to 5% by weight of a metal soap;

a black-color developing device that contains a black-color developing agent containing a black coloring agent, a binder resin and 0.01 to 5% by weight of a metal soap;

a magenta-color developing device that contains a magenta-color developing agent containing a magenta coloring agent, a binder resin and a metal soap which is smaller in amount than the metal soap contained in the yellow-color developing agent or which is zero in amount; and a cyan-color developing device that contains a cyan-color developing agent containing a cyan coloring agent, a binder resin and a metal soap which is smaller in amount than the metal soap contained in the yellow-color developing agent or which is zero in amount;

transferring the developing agent image onto a transfer material;

cleaning a developing agent remaining on the image carrier after transferring with use of a cleaning unit; and fixing the transferred developing agent image onto a transfer member.

12. An image forming method according to claim 11, wherein said plurality of developing devices further includes a magenta-color developing device housing a magenta-color developing agent containing a magenta coloring agent, a binder resin and a metal soap at an amount less than that of the metal soap contained in said yellow developing agent, and a cyan-color developing device housing a cyan-color developing agent containing a cyan coloring agent, a binder resin and a metal soap at an amount less than that of the metal soap contained in said yellow developing agent.

13. An image forming method according to claim 11, wherein a total amount of the contents of the metal soap used is 0.02 to 20% by weight of the total of the weights of the developing agents.

14. An image forming method according to claim 11, wherein the metal soap is selected from the group consisting of zinc stearate, aluminum stearate, calcium stearate, magnesium stearate, zinc behenate, aluminum behenate, calcium behenate, magnesium behenate, zinc laurate, aluminum laurate, calcium laurate and magnesium laurate.

15. An image forming method according to claim 11, wherein said plurality of developing device include a developing unit having two or more developing devices and a single color developing device provided independent from the developing unit.

16. An image forming method according to claim 11, wherein the cleaning unit includes a cleaning blade.

17. An image forming method according to claim 11, wherein only the yellow-color developing agent and the black-color developing agent contain the metal soap.

18. An image forming method according to claim 11, wherein:

the magenta-color developing agent contains a metal soap in an amount of 0.1 to 1.0% by weight, which is smaller in amount than the metal soap contained in the yellow-color developing agent; and the cyan-color developing agent contains a metal soap in an amount of 0.1 to 1.0% by weight, which is smaller in amount than the metal soap contained in the yellow-color developing agent.

19. An image forming method according to claim 11, wherein the step of forming a developing agent image comprises supplying a yellow-color developing agent prior to supplying a magenta and cyan color developing agents.

20. A combination of developing agents to be applied to an image forming method apparatus including a yellow-color developing device, a magenta-color developing device, a cyan-color developing device and a black-color developing device which are configured to form a developing agent image by developing a static latent image, comprising:

a yellow-color developing agent to be contained in the yellow-color developing device, the yellow-color developing agent containing a yellow coloring agent, a binder resin and 0.01 to 5% by weight of a metal soap;

a magenta-color developing agent to be contained in the magenta-color developing device, the magenta-color developing agent containing a magenta coloring agent, a binder resin and a metal soap which is smaller in amount than the metal soap contained in the yellow-color developing agent or which is zero in amount;

a cyan-color developing agent to be contained in the cyan-color developing device, the cyan-color developing agent containing a cyan coloring agent, a binder resin and a metal soap which is smaller in amount than the metal soap contained in the yellow-color developing agent or which is zero in amount; and a black-color developing agent to be contained in the black-color developing device, the black-color developing agent containing a black coloring agent, a binder resin and 0.01 to 5% by weight of a metal soap.

21. A combination of developing agents according to claim 20, further comprising: a magenta-color developing device to be contained in a still another one of said plurality of developing devices, containing a magenta-color developing agent containing a magenta coloring agent, a binder resin and a metal soap at an amount less than that of the metal soap contained in the yellow developing agent, and a cyan-color developing agent to be contained in a still another one of said plurality of developing devices, containing a cyan coloring agent, a binder resin and a metal soap at an amount less than that of the metal soap contained in the yellow developing agent.

22. A combination of developing agents according to claim 20, wherein a total amount of the contents of the metal soap used is 0.02 to 20% by weight of the total weight of the developing agents.

23. A combination of developing agents according to claim 20, wherein the metal soap is selected from the group consisting of zinc stearate, aluminum stearate, calcium stearate, magnesium stearate, zinc behenate, aluminum behenate, calcium behenate, magnesium behenate, zinc laurate, aluminum laurate, calcium laurate and magnesium laurate.

24. A combination of developing agents according to claim 20, wherein said plurality of developer device include a developing unit having two or more developing devices and a single color developing device provided independent from the developing unit.

25. A combination of developing agents according to claim 20, wherein only the yellow-color developing agent and the black-color developing agent contain the metal soap.

26. A combination of developing agents according to claim 20, wherein:

the magenta-color developing agent contains a metal soap in an amount of 0.1 to 1.0% by weight, which is smaller in amount than the metal soap contained in the yellow-color developing agent; and the cyan-color developing agent contains a metal soap in an amount of 0.1 to 1.0% by weight, which is smaller in amount than the metal soap contained in the yellow-color developing agent.

* * * * *